United States Patent [19]

Lein et al.

[11] Patent Number: 4,537,492

[45] Date of Patent: Aug. 27, 1985

[54] HEATER-DRIER FOR FUSING TONER IMAGES ON WET PRINTING PLATES

[75] Inventors: Juergen G. Lein, West Henrietta; Daniel H. Robbins, Rochester, both of N.Y.

[73] Assignee: Itek Corporation, Lexington, Mass.

[21] Appl. No.: 511,693

[22] Filed: Jul. 7, 1983

[51] Int. Cl.[3] ..... G03G 15/20

[52] U.S. Cl. ..... 355/3 FU; 219/216; 432/59

[58] Field of Search ..... 355/3 FU, 3 SH; 219/216, 388; 432/59, 230

[56] References Cited

U.S. PATENT DOCUMENTS 3,517,164 6/1970 Huggins et al. ..... 219/216 X
3,772,497 11/1973 Gray et al. ..... 355/3 FU X
3,857,189 12/1974 Katayama et al. ..... 219/388 X
4,059,394 11/1977 Ariyama et al. ..... 432/59
4,384,783 5/1983 Sakata et al. ..... 355/3 FU

*Primary Examiner*—A. T. Grimley
*Assistant Examiner*—J. Pendegrass

[57] ABSTRACT

A simple, reliable heater-fuser station for fusing toner images upon relatively stiff, resilient and moist printing plates includes a curved heater-platen positioned between a pair of entrance squeegee rollers and a pair of exit rollers. The angles between the plate material and the surfaces of the heater-platen due to roller orientations are such that the high beam strength and resiliency characteristics of the wet plates are advantageously employed to maintain intimate contact between the leading and trailing edge portions, as well as centralized portions, of the plates and the heater-platen.

6 Claims, 1 Drawing Figure

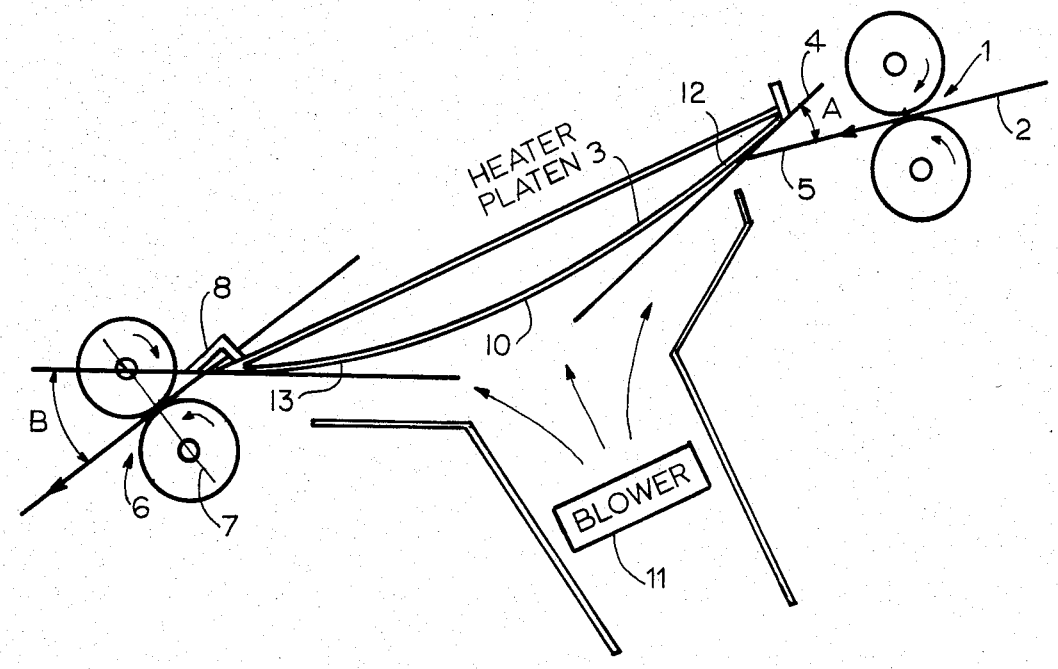
HEATER
PLATEN 3
BLOWER
1
2
4
5
6
7
8
10
11
12
13
A
B

HEATER-DRIER FOR FUSING TONER IMAGES ON WET PRINTING PLATES

BACKGROUND OF THE INVENTION

The present invention relates to the field of heater-drier stations for fixing toner images on sheet material.

The transportation of sheet material over a heated platen, having toner images to be fixed or fused thereon by the application of heat is well known in the art. It is old to pass such material over a curved blanket heater to produce sufficient heat by conduction upon the surface of the sheets to fix the images by fusion during the time interval of contact between the sheets and the curved platen. Many of these prior art curved heated platens have apertures therein wherein a vacuum is set up to suck the sheets against the heated surface of the platen to cause the sheets to remain in intimate contact with the heated platen during motion of the sheets through the fuser station. While these arrangements are often deemed satisfactory for fixing images on lighter, relatively flimsy electrostatic copy paper or plain paper, the use of a vacuum arrangement has been found to be undesirable where toner images are to be fixed by heat upon the surfaces of relatively heavy, stiff, wet photolithographic plates. This is because the vacuum required to cause the relatively heavy and stiff plates to adhere to the surface of the platen is considerable and is thus disadvantageous. Additionally, the large normal vacuum induced forces required to maintain the relatively stiff heavy plates in contact with the platen would in turn induce a high degree of sliding frictional resistance, particularly in the case of wet plates, which renders the driving of the plates through the heater station considerably more difficult.

It is thus an object of the present invention to provide a curved platen heater station for fixing toner images on relatively heavy, wet, stiff printing plates without the use of vacuum apertures formed in the heater platen.

In U.S. Pat. No. 3,517,164 to Huggins et al a curved heater-platen is disclosed together with a pair of input rollers which drives copy paper at the surface of the curved platen at an acute angle. The vacuum maintains the paper in contact with the surface of the platen and the leading edge of the paper passes through the bites of a pair of exit rollers so that the paper does not form an acute angle with respect to the surface portion of the platen adjacent the exit rollers. Since this reference employs vacuum to maintain contact of the paper with the platen it does not teach a practical solution for the above-stated problems solved by the present invention. In U.S. Pat. No. 4,059,394 to Ariyama et al, the leading edge of electrophotographic copy paper is directed at an acute angle with respect to the input surface of a heating platen. However, a toothed guide wheel is employed to force the leading edge of the paper downwardly to contact the major surface of the platen, and the leading edge thereafter passes over such surface through the bite of the exit roller pair. It is apparent, however, that the trailing edge portions of the sheets will not be firmly pressed against the platen (as required to fuse images on the relatively heavy plates) since the bite of the exit roller pair does not cause such trailing edge portions to form an acute angle with respect to the platen surface. Furthermore, this patent requires the use of a toothed wheel which must be rotated by a driving device to cause the leading edge to be forced downwardly toward the platen, and also requires a charge portion of platen surface portion 31*a* and is thus much more complex than the present invention. In contrast, the present invention employs the high resiliency of the relatively heavy and stiff plates to maintain the required intimate contact of all portions of the plates with the platen, without additional devices. Other less pertinent patents disclose various heater-platen arrangements such as U.S. Pat. No. 3,349,222; 4,075,456; 3,857,189 and 4,147,922.

Thus, it is an object of the present invention to provide a simple, reliable apparatus for fixing toner images by causing all portions of relatively heavy, stiff plates, including the leading and trailing edge portions thereof, to be in intimate contact with the surfaces of the heating platen. It is a further object of the present invention to eliminate transport guide members for controlling the path of motion of the printing plate over major platen surfaces, electrostatic charging techniques, or the use of vacuum techniques for maintaining sheet-platen contact.

SUMMARY OF THE INVENTION

In accordance with an embodiment of the present invention, a pair of entrance rollers cause leading edge portions of relatively stiff, heavy plates to come in contact with a first portion of the heater-platen at an acute angle which in turn causes the resilient plates to be firmly pressed against the platen. A pair of exit rollers are oriented to cause the trailing edge portions of the plates to snugly and intimately contact a second portion of the heater-platen adjacent the exit rollers. This is because the trailing edge portions of the plate have a tendency to "flick up" as they pass over the terminal portion of the heating platen due to the relatively high resiliency of the plates and the orientation of the rollers. As a result, not only the centralized portions of the printing plates are maintained in intimate contact with the platen to maximize heat conductivity, but both leading and trailing edge portions are so maintained in contact to ensure that no plate areas are insufficiently heated.

Other objects, features and advantages of the present invention will become apparent upon the study of the sole FIGURE which illustrates an embodiment of the invention.

SPECIFIC DESCRIPTION

In the FIGURE, a pair of entrance rollers 1 feed the above-mentioned plate material 2 toward a first platen portion, namely the surface of the right-hand portion 12 of the curved heater-platen 3, such platen also having a centralized portion 10. The entrance roller drive means 1 directs the leading edge of the plate material at an acute angle A defined by lines 4 and 5 in the FIGURE, and the leading edge portions are deflected downwardly as they travel over the first right-hand portion 12 of the platen. Since the plate material is relatively rigid (has a high beam strength) and resilient compared to the rigidity and resiliency of electrostatic copy paper, or for that matter ordinary paper, the deflection of the leading edge plate portions in a downward direction causes potential energy to be stored in the plate which now firmly presses itself against the platen. This action ensures an intimate contact between the heated surface of the platen and the leading edge portions of the plate. The leading edge of the plate, upon approaching exit roller pair 6, will pass through the bite of the exit rollers to be transported to a receiving station. During this time centralized portions of the plates are maintained in intimate contact with the surface of the heater-platen to cause the images thereon to be fixed in a highly controlled manner. A plane passing through the bite of exit rollers 6 perpendicular to straight line 7 between roller centers forms an acute angle B with respect to the second left-hand curved portion of the heater-platen 13 as indicated. As a resullt of such component orientation, the trailing edge portions are maintained in intimate contact with the second left-hand portion of the heater-platen 13 due to the tendency of the trailing edge portions to "flick up" against the heated platen owing to the stored potential energy of the deflected resilient plate. Wire guide 8 may be employed to deflect the leading edge downwardly towards the bite of the exit rollers 6. If the FIGURE is rotated 180°, that is, turned upside down, it should be apparent that the aforesaid structure would be sufficient to maintain all portions of the plate in intimate contact with the platen, including the leading and trailing edge portions. In the structure shown in the FIGURE (right side up) a blower 11 is included, which causes air to pass over the surface of the plate material having the toner image side facing downwardly toward the blower. The air striking the left-hand portion and the third central portion of the plate will tend to support the leading edge portions of the plate against gravity. However, the main function of the blower is to assist in the drying of the moist plates which have had most of the liquid removed therefrom by the operation of entrance roller pair 1, which function as squeegee rollers. In an embodiment of the invention built by the assignee of the present invention, the angle of attack A between the leading edge of the plate and the first right-hand platen surface was about 20°, and likewise angle B of the trailing plate edge portion with respect to the second left-hand platen portion was about 30°. However, angles of between 10° and 50° also produce highly desirable results. Angles greater than 50° would induce a tendency toward plate buckling. In the commercial embodiment, the angular velocity of the exit rollers was somewhat greater than the angular velocity of the entrance rollers in order to further ensure intimate plate to heater-platen contact by inducing tension in the plate material. Furthermore, with respect to the commercial embodiment, plate material was employed having a natural curl due to the wrapping of the plate material about spools during storage and shipment. The radius of curvature of platen 3 was made equal to the average radius of curvature of the plates due to such curling to enhance the conformity of the surface of the plate material with the curved surface portions of the heater-platen. The heater-platen had a curvature of 12 inch radius which is intermediate the maximum and minimum plate curl fed to the station. The platen was electrically controlled to maintain a platen surface temperature of between about 250° and 270°. With plate transport speeds of between 3.5 and 4 inches per second the outer image surface temperature of the plates facing the blower was about 150° F. The length of the fuser station was 7 inches.

In summary, the above-mentioned angular relationships of the leading and trailing edge plate portions with respect to the heater-platen, together with the relatively high beam strength and resiliency of the plates, ensure complete fusion of the images upon all portions of the plates. Thus, the characteristics of relatively stiff, resilient plates have been utilized advantageously in the present invention to produce the results mentioned above. The vacuum arrangements of the prior art, which would not produce satisfactory wet plate transportation over the platen, and other transport guide means such as belts, rotating wheels, etc., have been eliminated to simplify the heater-drier station and thus increase its reliability.

While specific embodiments of the invention have been described it should be understood that other embodiments may be designed which differ therefrom within the scope of the present invention, which is to only be restricted by the language of the following claims and equivalents thereof.

We claim:

1. Fuser drier for fixing toner images upon wet cut relatively stiff sheets having a beam flexure strength and resiliency substantially greater than the beam flexure stength and resiliency of electrostatic copy paper comprising:

a. a vacuumless curved platen for heating said relatively stiff sheets to fix said image;

b. a first entrance roller drive means for directing the lead edge of said sheets at a first acute angle of between 10° and 50° with respect to a first surface portion of said platen for maintaining substantial lead edge portions of said sheets in intimate contact with said first portion of said platen by virtue of said first acute angle and the resiliency of said sheets and;

c. a second exit roller drive means for withdrawing said sheets from said platen in a direction forming a second acute angle between 10° and 50° with respect to a second surface portion of said platen for maintaining substantial trailing edge portions of said sheets in intimate contact with said second portion of said platen, by virtue of said second acute angle and said resiliency of said sheets, said first and second surface portions being separated by a third curved surface portion for contacting major centralized portions of said sheets to fix the toner images thereon.

2. The combination as set forth in claim 1 wherein said first acute angle is about 20° and said second acute angle is about 30°.

3. The combination as set forth in claim 1, or 2 further including an air blower for directing air in an upward direction at the convex surface of said vacuumless curved platen.

4. Fuser drier for fixing toner images upon wet cut relatively stiff sheets having a beam flexure strength and resiliency substantially greater than the beam flexure strength and resiliency of electrostatic copy paper comprising:

a. a vacuumless downwardly convex curved platen for heating said relatively stiff sheets to fix said image;

b. a first entrance roller drive means for directing the lead edge of said sheets at a first acute angle between 10° and 50° with respect to a first surface portion of said platen for maintaining substantial lead edge portions of said sheets in intimate contact with said first surface portion of said platen by virtue of said first acute angle and the resiliency of said sheets; and c. a second exit roller drive means for withdrawing said sheets from said platen in a direction forming a second acute angle between 10° and 50° with respect to a second surface portion of said platen for maintaining substantial trailing edge portions of said sheets in intimate contact with said second surface portion of said platen by virtue of said second acute angle and said resiliency of said sheets, said first and second surface portions being separated by a third curved surface portion for contacting major centralized portions of said sheets to fix the toner images thereon, said second exit roller drive means having a greater angular velocity than the angular velocity of said first entrance roller drive means; and d. an air blower for directing air in an upward direction at the convex surface of said vacuumless convex curved platen.

5. The combination as set forth in claim 4 wherein said first acute angle is about 20° and said second acute angle is about 30°.

6. The combination as set forth in claims 1, 2, 4 or 5 wherein the radius of curvature of said curved platen is about equal to the radius of curvature of said sheet material where said sheet material is curled.

* * * * *